US006046562A

United States Patent [19]

Emil

[11] Patent Number: 6,046,562

[45] Date of Patent: Apr. 4, 2000

[54] SECURITY SYSTEM FOR AUTOMATIC DOOR

[76] Inventor: Blaine R. Emil, 8064 S. Quay Ct., Littleton, Colo. 80128

[21] Appl. No.: 09/110,068

[22] Filed: Jul. 3, 1998

[51] Int. Cl.[7] ..... E05F 15/20

[52] U.S. Cl. ..... 318/484; 318/467; 49/29; 388/909; 388/921

[58] Field of Search ..... 318/565, 264, 318/265, 266, 286, 466, 467, 468, 484, 490; 388/909, 921; 49/29, 30

[56] References Cited

U.S. PATENT DOCUMENTS

| | | | |
|---|---|---|---|
| 3,510,982 | 5/1970 | Purdy . | |
| 3,783,556 | 1/1974 | Cook | 49/25 |
| 4,463,292 | 7/1984 | Engelmann | 318/283 |
| 4,638,433 | 1/1987 | Schindler | 364/400 |
| 5,027,553 | 7/1991 | Vergara | 49/30 |
| 5,243,784 | 9/1993 | Whitaker et al. | 49/199 |
| 5,247,232 | 9/1993 | Lin | 318/468 |
| 5,357,183 | 10/1994 | Lin | 318/468 |
| 5,510,686 | 4/1996 | Collier | 318/446 |
| 5,673,514 | 10/1997 | McKeon | 49/30 |
| 5,752,343 | 5/1998 | Quintus | 49/29 |

*Primary Examiner*—Bentsu Ro
*Attorney, Agent, or Firm*—Lee G. Meyer; Patton Boggs, LLP

[57] ABSTRACT

A system and device for insuring the integrity of an automatic door has a sensor to determine the status of the door with respect to a predetermined position and a programable actuator which provides a positive signal for automatically moving the door to the predetermined position when the programmable actuator is activated and the sensor indicates that the door is at other than the predetermined position. Preferably the programmable actuator is a timer and the predetermined position is closed. The timer can be remotely programmable. The actuator can also be triggered by a sensor of an event such as darkness.

20 Claims, 3 Drawing Sheets

SECURITY SYSTEM FOR AUTOMATIC DOOR

BACKGROUND

1. Field of the Invention

The invention relates to security systems for use with an automatic door; and, more particularly to a security device for moving an automatic door into a predetermined position.

2. Description of Related Art

Automatic doors including automatic security doors, and specifically automatic garage doors are familiar and convenient. This type of door is on a motorized mechanism to automatically open andlor close the door. The mechanism can be actuated remotely by means of a radio receiver system or conventionally by means of a switch. Overhead garage doors typically roll on tracks, reversibly, from a closed vertical position to an open horizontal position.

Occasionally, these automatic doors are left ajar or open, whether intentionally or accidently. This is especially problematic with garage doors because the garage usually provides for unrestricted access to the interior of the house, as well as subjecting the contents of the garage to theft. In hot weather the garage door may be purposely left ajar to facilitate cooling. Unfortunately, this allows for easy access to contents. Kids also open these doors and don't close them. Even a door left only slightly ajar presents a breach of security, since an intruder can merely crawl through the opening. Further, automatic doors equipt with radio receiver activated openers, are subject to activation by stray signals. Many TV remote controls, and other wireless controls can activate an automated system which inadvertently opens the automatic door.

This breach of security has been recognized as a problem in the prior art. There have been other proposals for closing open garage doors, such as shown in U.S. Pat. Nos. 4,035,702; 4,463,292; and 5,510,686. However, these devices close the door after it had been open for a predetermined amount of time. There are disadvantages to this, one of which is that the door starts closing without warning. This might result in the door closing on a vehicle or locking a person out of his house. Another problem with this concept is that the door always closes after it has been open a certain amount of time. Thus, if one wanted to leave the door open during the day, they would have to deactivate the closing system. Then the person would have to remember to reactivate the system.

Another problem associated with these systems is that they only function when the door is in its full open position. If the door is only ajar to allow for ventilation during the summer, these systems would not close the door, allowing it to remain open all night. This would allow an intruder to slip under the door and take items from the garage and the unlocked car parked inside. Or worse gain entry to the house.

It therefore would be advantageous to have a system, which was programmable which would automatically close the door no matter the degree to which it was opened; or in the alternative, open the door on programmable command.

SUMMARY OF THE INVENTION

It has now been discovered, that the security of an automatic opening doors can be obtained by means of a programmable, activation device which senses the condition of the door at a prescribed time and then sends a signal to activate the automatic system and if the door is sensed to be out of the predetermined position, to move the door to the predetermined position.

In the broad aspect, an automatic door having an automatic means for opening and/or closing has a time or event programmable actuator and a signal generating sensor for determining door position. When the actuator is activated in response to the occurrence of the programmable event, the sensor generates a signal as a function of a pre-determined door position such that if the door is out of position the operating unit is actuated to move the door into the predetermined position at which time the signal ceases and the operation unit is deactivated.

In one aspect a timer is used as the programable actuator. In another aspect a means for perceiving a predetermined event, such as sun up or sun down or intruder motion is used to trigger the system. In one embodiment the system is preprogramed to open or lift the door. In another embodiment the system is preprogramed to close the door. In a further embodiment the system is preprogramed to set the door ajar. In accordance with one embodiment, the system can move the door from one preprogramed position to a second by means of cycled or timed activation such as from closed to partly open to effect limited ingress and egress.

In accordance with the invention, the system comprises a device that attaches to a motorized garage door opener for sensing that the door is in other than a closed position, and automatically closing the door at a preprogrammed time. The device does not interfere with the required reversing safety feature. The device allows for a person to program a specific time, or times, each day that the garage door will be closed and does not effect any other normal operation, e.g. the use of the transmitter, or the hard wired switch, to control the garage door. In another embodiment the position of an automated security gate is sensed, and moved to the desired position.

The device of the instant invention includes a programmable actuator, such as a timer or an event actuated transducer, and a sensing means to determine the position of the door at the time the actuator is activated. The sensing means detects the door position and generates the appropriate signal for actuating the operator unit which moves the door, if required, to the predetermined position.

In the preferred embodiment, the actuator and the sensor are powered by the operator unit. The actuator comprises a programmable timer or transducer which closes a circuit and a sensor means having a sensor to sense the location of the door along its trajectory. In one embodiment the sensor means is a whiskered micro switch which opens the circuit when the door is closed.

DESCRIPTION OF THE PREFERRED EMBODIMENT

Figure 1:
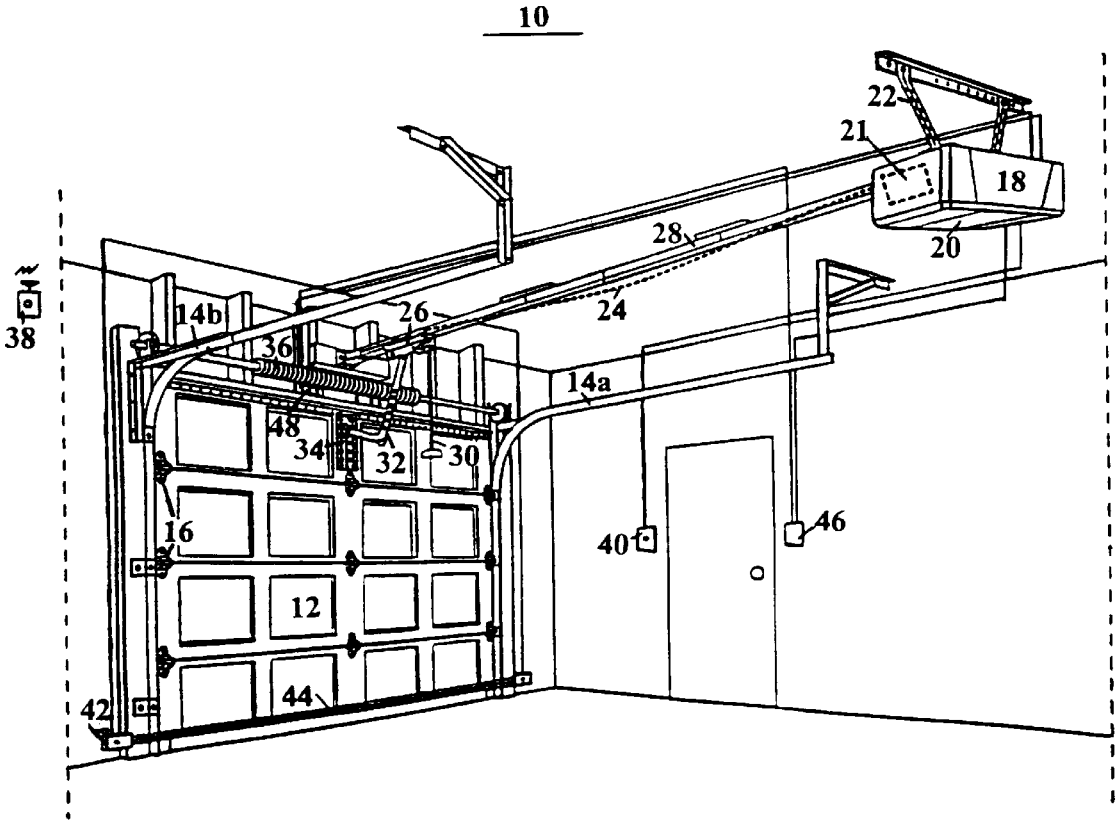
FIG. 1 is a perspective view illustrating a garage door opening system employing the device of the instant invention.

A garage door opening system 10 is shown in FIG. 1. Door 12 is mounted on tracks 14*a* and 14*b* so that it can be moved vertically to a fully opened position that is above the garage floor. Often door 12 will contain horizontal hinges 16 to facilitate the opening and closing movement. The door is raised via a reversible motor 18 housed in the motor housing 20 which is mounted on the ceiling with bracket 22. The reversible motor 18 drives a chain 24 which is connected to a trolley 26. The trolley 28 rides a rail 28. The trolley 26 contains a release cord 30 and a hinged lever arm 32 is attached to the door 12 by means of a bracket 34.

Thus, the motor 18 reversibly drives the chain 24, to in turn drive the trolley 26 to raise or lower the door 12. A shaft 34, rotatably mounted above the door 12, has a conventional counterweight spring 36, to counter balance the weight of the door 12. The motor 18 is energized by completing the circuit through a signal from a remote transmitter 38 to a the remote transmitter receiving switch 21 or a hard wired wall switch 40. The system 10 has a standard obstruction sensor 42 which reverses the downward direction of the door 12 when the signal 44 is interrupted. The radio signal from the remote transmitter 38 is detected by the receiving switch 21, decoded, and triggers the activation of the door opener motor 18.

Sensor 42 has a beam 44 which provides obstruction detection, i.e., detects the presence of an obstruction in the path of the door if the door is in motion. If beam 44 is obstructed or interrupted, then the sensor system sends a signal which causes the motor 18 to reverse, if it is lowering the door 12, and return to its fully opened position.

A programmable security system in accordance with the invention, has a micro switch 48 and a programmable timer 46 in communication with reversible motor 18. The micro switch 48 is located proximate the top of door 12, and as better seen in FIG. 2, has a whisker 50. In operation, whisker 50 detects whether garage door 12 is in the closed position when timer 46 is activated to close the circuit. If the door 12 is in the closed position micro switch 48 is open and the circuit is not completed i.e. the door 12 is in the system predetermined position.

In operation, the micro switch 48 is positioned on the frame or jam of the garage door 12 proximate the center of the jam, so whisker 50 makes contact with the door 12 when it is in its fully closed position. A wire connects micro switch 28, in series, with one terminal of the timer 46, mounted on the garage wall, and with one terminal of the automatic garage door opener motor 18. Another wire connects the other terminal of the timer 46 with the other terminal on the automatic garage door opener motor 18. When the timer clock 46 reaches the predetermined time a relay is closed and the current is allowed to flow through for 2 seconds. If the door 12 is in any position other than completely closed, the micro switch 48 will be in the closed position and the automatic garage door opener system will be activated and the door 12 will be closed. Since the current is allowed to flow for only 2 seconds (same as pushing the wall button) the timer will not interfere with the reversing safety feature of the garage door opener.

In one aspect, the device of the invention is designed as a low-cost add-on for a wide range of automatic, motorized, garage door opening systems. Consequently, the device may be added to any existing system that allows for a wall mounted push button 40 to be connected, since the same connecting points are used for the device. The wiring of the existing system does not need to be disturbed, nor is the existing operation via the transmitter or the push-button disturbed.

Figure 2:
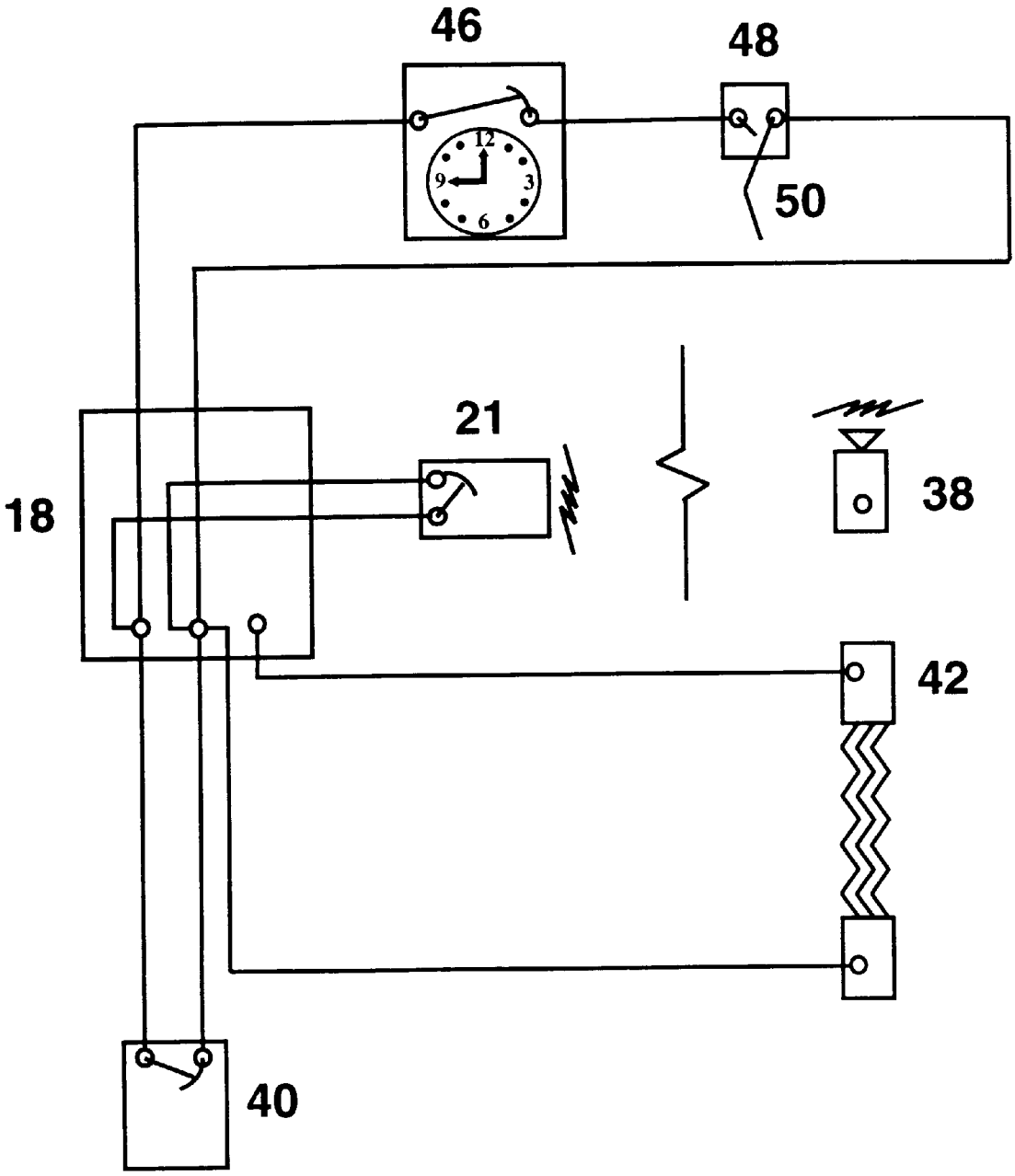
FIG. 2 is a schematic electrical circuit diagram illustrating the programmable security system in accordance with the instant invention.

Turning to FIG. 2, there is shown circuitry for the programmable security timer device of the instant invention. Remote transmitter receiving switch 21 or a hard wired wall switch 40 communicate with motor 18 which is energized by an external source not shown. A programmable timer 46, and micro switch 48, having a whisker 50 likewise communicate with motor 18. Security reversing apparatus 42 is wired to break the circuit and reverse the motor 18 if the motor is in motion, such that the door 12 is traveling in a downward position. Thus as shown in FIG. 2, the circuitry of the instant invention does not interfere with the normal operation of the automatic garage door circuitry but rather operates parallel thereto. When programmable timer switch 46 closes, the system is only activated if the micro switch 48 is also in a closed position. The micro switch 48 is only closed when the door is in other than the closed position such that the whisker 50 is not in contact with door 12.

Thus, in accordance with this embodiment, a programmable timer means, for an automatic garage door senses that the door is not closed and causes the door to close at a prescribed time. In operation a timer is programmed either manually, remotely, or a circuit is closed by a predetermined condition. When the circuit is closed, a sensor, such as a whiskered micro switch, is tested for a predetermined setting. If the setting is achieved the circuit is broken and the door mechanism is not actuated. If the setting is not achieved, the mechanism is actuated until the setting is achieved and the circuit is then broken.

Figure 3:
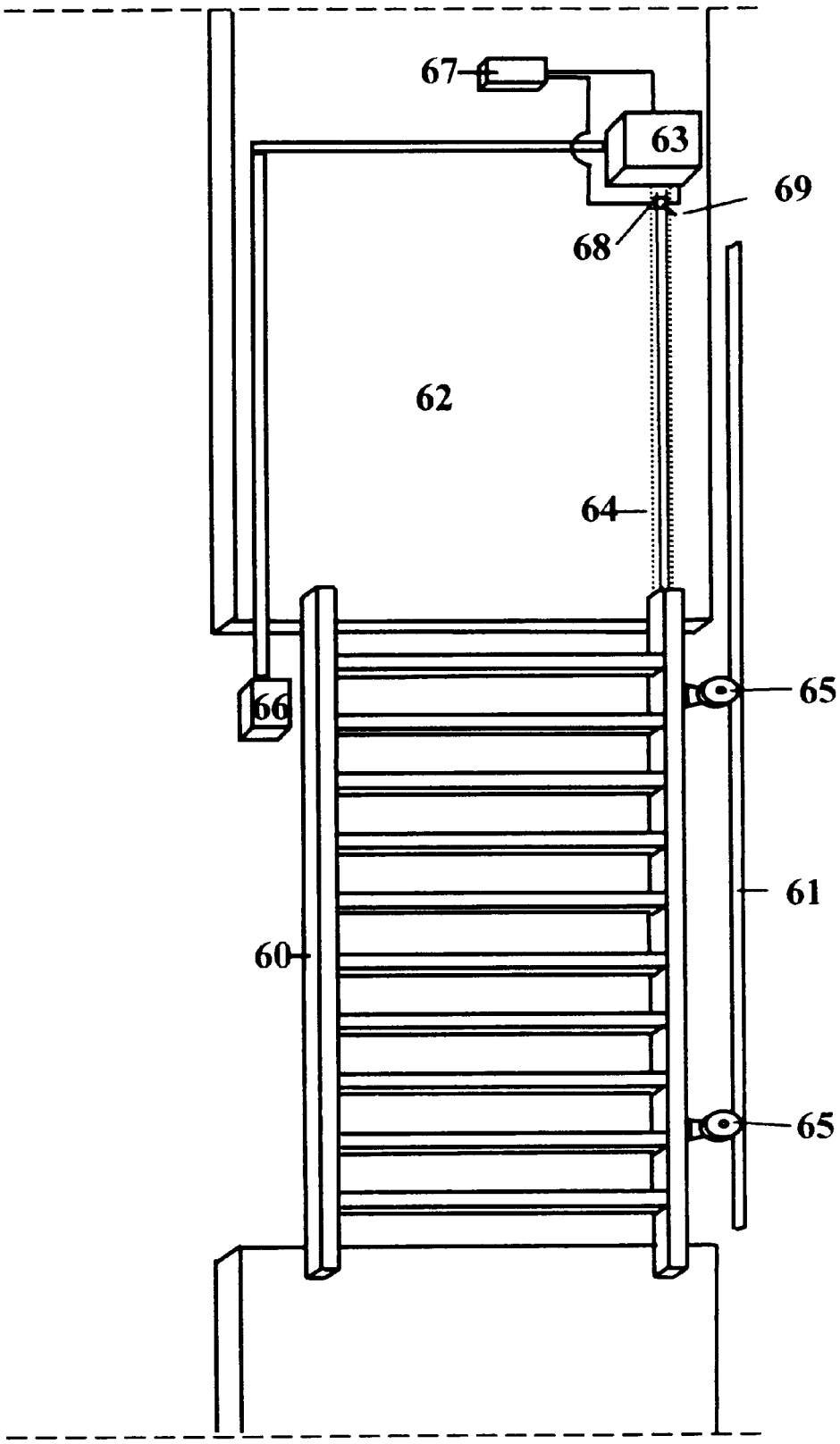
FIG. 3 is a perspective view illustrating a an automatic security gate having a programmable security system in accordance with this invention.

A gate automatic security gate opening system in accordance with the invention is shown in FIG. 3. Gate 60 having rollers 65 sits on track 61 so that it can be moved horizontally to a fully opened position behind wall 62. The gate 60 is moved via a reversible electric motor 63 mounted on wall 62. The electric motor moves a chain 64 connected to gate 60. Thus, the motor 63 moves the chain 64, thereby opening the gate 60. The motor 63 can be activated by push button 66. A programmable timer 67 communicates with micro switch 68 having a whisker 69. The micro switch 68 is positioned near track 65 so that whisker 69 makes contact with the gate 60 when it is in its fully opened position. The micro switch 68 is normally open. Micro switch 68 is connected in series, with one terminal of the timer 67 and with one terminal of the electric motor 63. The other terminal of timer 67 is connected to the other terminal on the electric motor 63. When the clock reaches the predetermined time, a relay is closed and the current is allowed to flow through for 2 seconds. If the gate 60 is in the open position the micro switch 68 will be closed and the electric motor 63 will be activated and the door 60 will be closed.

The sensors that can be used in accordance with the invention are well known in the art such as mechanical, IR, optical, photo voltaic, motion, and the like. The programmable actuators can be a timer which can be conventional such as a clock a timed circuit or the like. Event actuated transducers can be IR, Laser, optical, photo voltaic, motion sensors and the like.

Thus there has been shown and described a novel automatic door positioning device, method and apparatus which fulfills all of the objectives and advantages sought therefor. Many changes, modifications, and other uses and applications of the subject invention will, however, become apparent to those skilled in the art after considering this specification together with the accompanying drawings and claims. All such changes, modifications, variations and other uses and applications which do not depart from the spirit and the scope of the invention are deemed to be covered by the invention which is limited only by the claims which follow.

What is claimed is:

1. A programmable device for automatic doors comprising:

(a) an automatic door which can be moved by an electric motor means;

(b) a sensing means to determine a predetermined position of the door electrically communicating with said electric motor means by means of a switch which is open when said door is in said predetermined position and closed when said door is not in said predetermined position; and, (c) a continually powered programmable actuator means electrically communicating with said electric motor means by way of said sensing means to selectively actuate said electric motor means upon the happening of a pre programmed event such that when said switch is closed said door is moved toward said predetermined position and when said switch is open said electric motor means is deactivated.

2. The programmable device for automatic doors of claim 1 wherein said door is selected from the group consisting of a security gate, a security door, an entry door, and a garage door.

3. The programmable device for automatic doors of claim 1 wherein said door is an overhead garage door.

4. The programmable device for automatic doors of claim 1 wherein said programmable actuator means is selected from the group consisting of a timer and an event actuated transducer.

5. The programmable device for automatic doors of claim 1 wherein said programmable actuator means is remotely programmable.

6. The programmable device for automatic doors of claim 1 wherein said programmable actuator means is an event actuated transducer selected from the group consisting of a photo voltaic cell, an optical detector, an ir beam, and a motion detector.

7. The programmable device for automatic doors of claim 1 wherein the sensing means is selected from the group consisting of mechanical, IR, optical, photo voltaic, and a motion detector.

8. The programmable device for automatic doors of claim 1 wherein the sensing means is a micro switch.

9. The programmable device for automatic doors of claim 1 wherein the predetermined position is selected from the positions of open, closed, and ajar.

10. A method for programmably assuring that an automatic door is maintained in a predetermined position comprising:

(a) programming a continually powered actuator means communicating with an electric motor means for opening and closing said automatic door;

(b) sensing whether said automatic door is in a predetermined position;

(c) actuating said motor means in response to said actuator means if said door is other than in said predetermined position to move said door into said predetermined position; and, (d) deactuating said motor means when said door arrives at said predetermined position.

11. The method of claim 10 wherein said door is selected from the group consisting of a security gate, a security door, an entry door, and a garage door.

12. The method of claim 10 wherein said door is an overhead garage door.

13. The method of claim 10 wherein said programmable actuator means is selected from the group consisting of a timer and an event actuated transducer.

14. The method of claim 10 wherein said actuator means is remotely programable.

15. The method of claim 10 wherein said actuator means is an event actuated transducer selected from the group consisting of a photo voltaic cell, an optical detector, an ir beam, and a motion detector.

16. The method of claim 10 wherein the sensing step is accomplished with a micro switch.

17. The method of claim 10 wherein the predetermined position is selected from the positions of open, closed, and ajar.

18. A programmable device for closing an automatic overhead garage door having a door jam comprising:

a micro switch on the jam adapted to be open when the door is closed;

a continually powered programmable timer having a closable switch electrically communicating with said micro switch; and, an electric motor for automatically raising and lowering the door in electric communication with said programmable timer by way of said micro switch such that when said switch on said timer closes and the micro switch is closed electric motor is actuated to close the door until the micro switch is open.

19. The programmable device of claim 18 wherein said programmable timer is remotely programmable.

20. The programmable device of claim 18 further comprising an obstruction sensor in communication with said motor.

* * * * *